US005219383A

United States Patent [19]

Minari et al.

[11] Patent Number: 5,219,383

[45] Date of Patent: Jun. 15, 1993

[54] ICE MAKING MACHINE

[75] Inventors: Katsunobu Minari; Hiroshi Torimitsu, both of Nagoya, Japan

[73] Assignee: Hoshizaki Denki Kabushiki Kaisha, Tokoake, Japan

[21] Appl. No.: 888,110

[22] Filed: May 26, 1992

[30] Foreign Application Priority Data

May 23, 1991 [JP] Japan ..... 3-149634
May 23, 1991 [JP] Japan ..... 3-149635
May 24, 1991 [JP] Japan ..... 3-47033

[51] Int. Cl.[5] ..... F25C 1/00
[52] U.S. Cl. ..... 62/347; 62/74
[58] Field of Search ..... 62/66, 74, 340, 347, 62/430

[56] References Cited

U.S. PATENT DOCUMENTS 2,875,588 3/1959 Berger ..... 62/74
3,162,019 12/1964 Porter et al. ..... 62/347 X
3,653,222 4/1972 Dunn et al. ..... 62/74
4,077,227 3/1978 Larson ..... 62/74
4,801,436 1/1989 Connery ..... 62/66 X

FOREIGN PATENT DOCUMENTS 556892 7/1932 Fed. Rep. of Germany ..... 62/347
1-210773 8/1989 Japan .
210773 8/1989 Japan ..... 62/66
118373 5/1990 Japan ..... 62/66
217770 8/1990 Japan ..... 62/340
309165 12/1990 Japan ..... 62/340
2111184 6/1983 United Kingdom ..... 62/340

*Primary Examiner*—William E. Tapolcai
*Attorney, Agent, or Firm*—Nikaido, Marmelstein, Murray & Oram

[57] ABSTRACT

An ice making machine includes a cooling vessel arranged to store an amount of liquid cooling medium and an amount of separation medium located above the cooling medium. A refrigeration mechanism is provided for refrigerating both the mediums in the cooling vessel, and a water supply system is provided for supplying fresh water in the form of water drops into the liquid cooling medium. The water drops are formed into ice balls while rising in the liquid cooling medium, and the formed ice balls are separated from the liquid cooling medium in the separation medium to be harvested. In this ice making machine, mercury is used as the liquid cooling medium, and hydrophobic liquid is used as the separation medium. The melting point of the separation medium is lower than that of the formed ice balls and the specific gravity of the separation medium is more than the formed ice balls and less than the mercury.

10 Claims, 1 Drawing Sheet

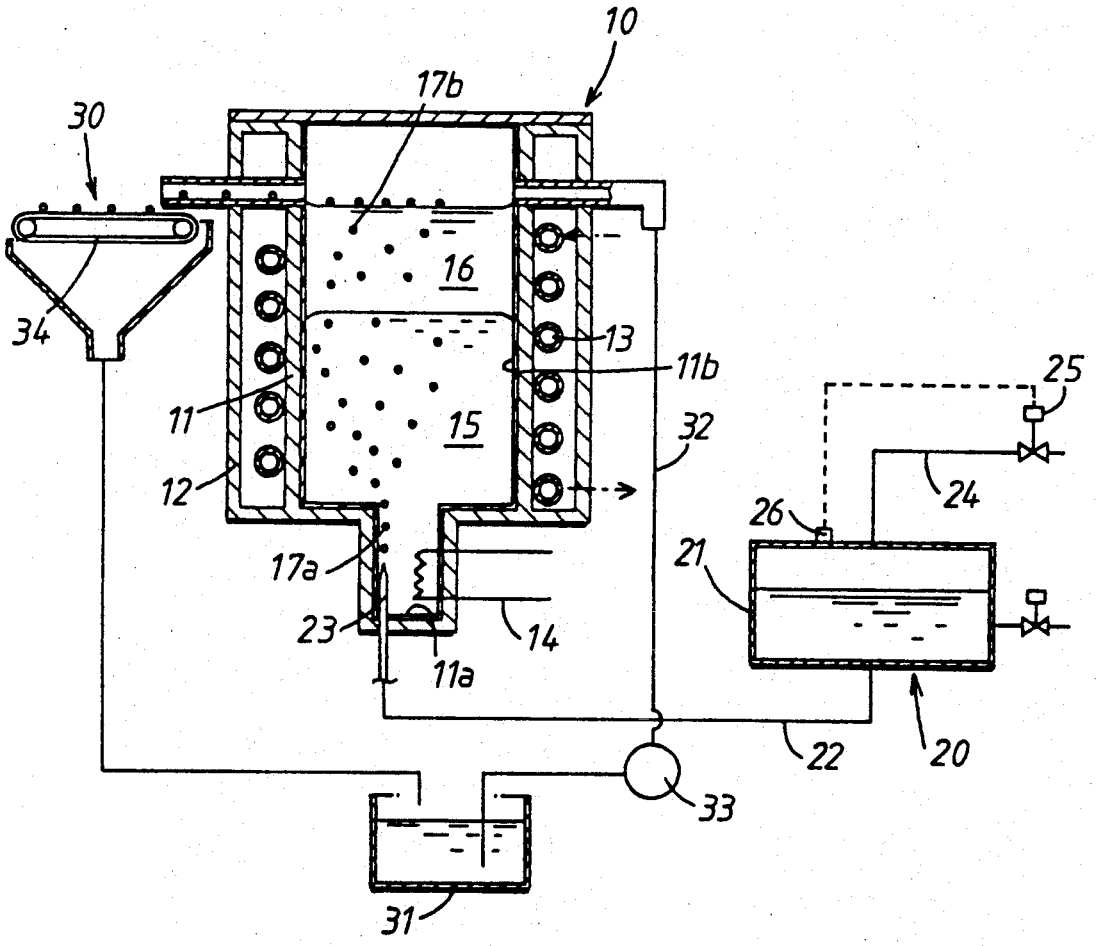
10
17b
30
16
34
13
11b
25
11
15
32
24
12
26
17a
21
23
14
11a
22
20
33
31

ICE MAKING MACHINE

BACKGROUND OF THE INVENTION

1. Field of the Invention

The present invention relates to an ice making machine, and more particularly to an ice making machine for making spherical ice cubes or ice balls suitable for use in deburring, shot blasting, hydraulic honing or similar applications.

2. Description of the Prior Art

In Japanese Patent Laid-open Publication No. 1-210773, there has been proposed an ice making machine which comprises a cooling vessel arranged to store an amount of liquid cooling medium and an amount of separation medium located above the cooling medium. Refrigeration means are provided for refrigerating both the mediums and water supply means are provided for supplying fresh water in the form of water drops into the liquid cooling medium. The water drops are formed into spherical ice cubes or ice balls as the water drops rise in the liquid cooling medium, and the formed ice balls are then separated from the liquid cooling medium in the separation medium to be harvested. In this ice making machine a fluorocarbon solution is used as the liquid cooling medium, and water is used as the separation medium.

In this ice making machine, however, the water temperature must be maintained at approximately 0° C. in order to prevent the ice balls formed in the fluorocarbon solution from combining with each other into ice blocks in the separation medium, and also from dissolution in the separation medium. To solve these problems, these ice making machines can be equipped with a heater, an agitator, and a thermal control apparatus for precise control of the water temperature. With reason, these added elements however, the ice making machine becomes complicated in construction and large in size, resulting in an increase of the manufacturing cost. This type of device also fails to prevent that the separation medium or water from becoming frozen at the controlled temperature of approximately 0° C. and also fails to prevent the formed ice balls from becoming melted and combined into ice blocks.

SUMMARY OF THE INVENTION

It is, therefore, a primary object of the present invention to provide an ice making machine wherein mercury is used as the liquid cooling medium, and wherein hydrophobic liquid is used as the separation medium. The melting point of such a separation medium is lower than that of the formed ice balls, and the specific gravity of the separation medium is more than the formed ice balls and less than the mercury. In a practical embodiment of the present invention, castor oil, cyclohexyl acetate, trichloroethylene, perchloroethylene or similar substances are used as the hydrophobic liquid.

In the ice making machine of the present invention both the mercury and hydrophbic liquid in the cooling vessel are maintained at a predetermined temperature lower than 0° C. prior to making ice balls, and the water drops supplied into the cooling vessel are formed into ice balls in as they rise in the mercury and are separated from the mercury in the hydrophobic liquid. The ice balls further rise in the hydrophobic liquid and float thereon to be harvested. Since the mercury used as the liquid cooling medium has a high specific gravity (13.5 g/cm), the formed ice balls become hard and fine in structure. Since the hydrophobic liquid is used as the separation medium, the ice balls formed in the mercury are smoothly transferred into the hydrophobic liquid and separated from the mercury without becoming combined into large ice blocks. Since the melting point of the hydrophobic liquid is maintained lower than that of ice, the formed ice balls can be harvested without becoming melted by the hydrophobic liquid, and the hydrophobic liquid is maintained without freezing at the boundary relative to the mercury layer. Accordingly, the ice making machine can be provided with a simple construction without providing the conventional heater for the prevention of unwanted freezing and the thermal control apparatus for precise control of the separation medium temperature. Since the thermal conductivity of the hydrophobic liquid is smaller than that of the mercury, the hydrophobic liquid is useful to prevent loss of energy caused by thermal transmission between the mercury layer and the exterior.

BRIEF DESCRIPTION OF THE DRAWING

Additional objects, features and advantages of the present invention will be more readily appreciated from the following detailed description of a preferred embodiment thereof, when taken together with the accompanying drawing.

DESCRIPTION OF THE PREFERRED EMBODIMENT

Referring now to the drawing, a preferred embodiment of an ice making machine according to the present invention includes a cooling vessel 10, a water supply system 20 and an ice delivery system 30. The cooling vessel 10 is composed of an internal cylindrical housing 11 and an external cylindrical housing 12 between which an evaporator coil 13 is assembled. The evaporator coil 13 is connected to a well-known conventional refrigeration system (not shown) to be supplied with refrigerant therefrom in operation.

The internal cylindrical housing 11 is provided at the central portion of the bottom thereof with a recessed portion 11*a* which is formed to contain therein a nozzle 23 of the water supply system 20 and a heater 14 located adjacent the nozzle 23. The internal cylindrical housing 11 stores an amount of liquid cooling medium 15 and an amount of separation medium 16. In this embodiment, mercury is used as the cooling medium 15, and hydrophobic liquid such as castor oil is used as the separation medium 16. The hydrophobic liquid is located above the mercury layer 15 due to a difference in specific gravity.

The water supply system 20 includes a water tank 21, a water supply conduit 22, the nozzle 23 and a pneumatic pressure conduit 24. The water tank 21 is arranged to store a predetermined amount of fresh water for supplying the stored fresh water into the bottom of internal cylindrical housing 11 through the conduit 22 and nozzle 23, under the pneumatic pressure applied from conduit 24. The fresh water from tank 21 is supplied as water drops into the mercury layer 15 in housing 11 by means of the nozzle 23, and the pneumatic pressure in water tank 21 is controlled by an electromagnetic valve 25. The ice delivery system 30 includes a reservoir tank 31, a circulation conduit 32, a pump 33 and a conveyor 34 for delivery of formed ice balls. In the ice delivery system 30. The hydrophobic liquid 16 is circulated under operation of the pump 33 in such a manner as to flow through the circulation conduit 32, the surface portion of hydrophobic liquid 16 in housing 11, the conveyor 34, and the reservoir tank 31.

In operation of the ice making machine, both the mediums 15, 16 in internal cylindrical housing 11 of the cooling vessel 10 are maintained at about −15° C., and the hydrophobic liquid 16 is circulated under operation of the pump 33 to flow through the surface portion of hydrophobic liquid 16 in housing 11. In such a condition, the fresh water from the water supply system 20 is supplied as water drops 17*a* into the mercury layer 15 through the nozzle 23. The water drops 17*a* are formed into ice balls 17*b* while rising through the mercury layer 15. The formed ice balls 17*b* are then separated from the mercury layer 15 in the hydrophobic liquid 16 to be floated on the surface of the hydrophobic liquid 16. The ice balls 17*b* floated on the surface of the hydrophobic liquid 16 are delivered outwardly from the internal cylindrical housing 11 by means of the flow of circulating hydrophobic liquid 16 and received by the conveyor 34 to be harvested. The hydrophobic liquid separated from the ice balls is recirculated into the internal cylindrical housing 11 through the reservoir tank 31 and circulation conduit 32 under operation of the pump 33.

Since mercury of large specific gravity (13.5 g/cm$^3$) is used as the cooling medium 15, the formed ice balls become hard and fine in structure. Since the castor oil of the separation medium has a small specific gravity (0.95 g/cm$^3$), the ice balls 17*b* formed in the cooling medium 15 are smoothly transferred into the separation medium 16 and separated from the cooling medium 15 without becoming combined into large ice blocks. Thus, the ice balls can be obtained in a desired size and smoothly delivered from the cooling vessel 10. Since the melting point of the separation medium 16 is lower than that of the ice balls, the formed ice balls can be harvested without becoming melted by the separation medium, and the separation medium is maintained without freezing at the boundary relative to the cooling medium 15. Accordingly, the ice making machine can be provided with a simple construction without providing the conventional heater for the prevention of freezing and the thermal control apparatus for precise control of the separation medium temperature. Since the thermal conductivity of the separation medium 16 is smaller than that of the cooling medium 15, the separation medium is useful to prevent loss of energy caused by thermal transmission between the cooling medium and the exterior In the ice making machine of the present invention the heater 14 is arranged within the recessed portion 11*a* of housing 11 to minimize the heat added to the cooling medium 15 and is located adjacent the nozzle 23 to prevent freezing of the water in nozzle 23. The ejection amount and speed of the water drops 17*a* supplied from the water tank 21 are finely adjusted by control of the electromagnetic valve 25 to obtain the ice balls in a desired size. For such a fine adjustment, the pressure in water tank 21 is detected by the pressure sensor 28, and the opening degree of the electromagnetic valve 25 is controlled in dependence upon a value detected by the pressure sensor 26. When the ice making machine is inoperative, the pneumatic pressure applied to the water is balanced with the pressure of cooling medium 15 to prevent ejection of the water drops and to prevent reverse flow of the cooling medium into the nozzle 23.

In a practical embodiment of the present invention, salt solution such as potassium chloride solution, sodium chloride solution or the like may be used as the separation medium 16. In the case that the potassium chloride solution is used as the separation medium, the solution temperature decreases to −12.8° C. in maximum due to molar depression of the freezing point of the solution. Thus, the ice balls 17*b* can be obtained in a desired size without becoming combined into ice blocks.

In this ice making machine, it has been found that the supplied water drops and the formed ice balls tend to adhere to the inner wall surface of housing 11 while rising in the cooling and separation mediums. Particularly, in the case that the supply amount of water drops is increased to enhance the ice making efficiency, the adherent amount of ice balls increases to reduce the cooling performance of the machine. To avoid such problems, it is desirable that the inner wall surface of housing 11 is coated with water repellent synthetic resin such as polytetrafluoroethylene, polypropylene or polyamides as shown by the reference numeral 11*b* in the drawing.

What is claimed is:

1. An ice making machine, comprising:

a cooling vessel arranged to store an amount of liquid cooling medium and an amount of separation medium located above the cooling medium;

refrigeration means for refrigerating both the mediums in said vessel;

water supply means for supplying fresh water in the form of water drops into the liquid cooling medium, wherein the water drops are formed into ice balls while rising in the liquid cooling medium and the formed ice balls are separated from the liquid cooling medium in the separation medium to be harvested, wherein mercury is used as the liquid cooling medium and hydrophobic liquid is used as the separation medium, the melting point of the separation medium is lower than that of the formed ice balls, and wherein the specific gravity of the separation medium is more than the formed ice balls and less than the mercury.

2. An ice making machine as claimed in claim 1, wherein castor oil is used as the hydrophobic liquid.

3. An ice making machine as claimed in claim 1, wherein an inner wall surface of said cooling vessel is coated with water repellent synthetic resin.

4. An ice making machine, comprising:

a cooling vessel arranged to store an amount of liquid cooling medium and an amount of separation medium located above the cooling medium;

refrigeration means for refrigerating both the mediums in said vessel;

water supply means for supplying fresh water in the form of water drops into the liquid cooling medium, wherein the water drops are formed into ice balls while rising in the liquid cooling medium and the formed ice balls are separated from the liquid cooling medium in the separation medium to be harvested, wherein mercury is used as the liquid cooling medium and salt solution is used as the separation medium.

5. An ice making machine as claimed in claim 4, wherein the salt solution is potassium chloride solution.

6. An ice making machine as claimed in claim 4, wherein the salt solution is sodium chloride solution.

7. An ice making machine as claimed in claim 4, wherein an inner wall surface of said cooling vessel is coated with water repellent synthetic resin.

8. An ice making machine as claimed in claim 7, wherein the water repellent synthetic resin is polytetrafluoroethylene.

9. An ice making machine as claimed in claim 7, wherein the water repellent synthetic resin is polypropylene.

10. An ice making machine as claimed in claim 7, wherein the water repellent synthetic resin is polyamides.

* * * * *

UNITED STATES PATENT AND TRADEMARK OFFICE

CERTIFICATE OF CORRECTION

PATENT NO. : 5,219,383

DATED : June 15, 1993

INVENTOR(S) : Katsunobu MINARI et al

It is certified that error appears in the above-identified patent and that said Letters Patent is hereby corrected as shown below:

On the cover page, Item [73], second line, change "Tokoake" to -- Toyoake --.

Signed and Sealed this

Twenty-second Day of February, 1994

*Attest:*

Bruce Lehman

BRUCE LEHMAN

*Attesting Officer*

*Commissioner of Patents and Trademarks*